United States Patent [19]

Timander et al.

[11] 4,452,458

[45] Jun. 5, 1984

[54] DEVICE TO DETERMINE, INDICATE AND RECORD AIM OF OBJECT

[75] Inventors: Karl O. Timander, Timmersdala; Ulf O. Johansson, Bromma, both of Sweden

[73] Assignee: C. Carl Timander, Rochester, Minn.; a part interest

[21] Appl. No.: 385,168

[22] Filed: Jun. 4, 1982

[30] Foreign Application Priority Data

Sep. 18, 1981 [SE] Sweden ..... 8105536

[51] Int. Cl.[3] ..... F41F 27/00

[52] U.S. Cl. ..... 273/310; 434/22

[58] Field of Search ..... 434/22; 273/310, 311, 273/312, 314, 313

[56] References Cited

U.S. PATENT DOCUMENTS

| | | | |
|---|---|---|---|
| 3,271,032 | 9/1966 | Rabinowitz et al. | 273/310 |
| 3,339,293 | 9/1967 | Kuhlo et al. | 434/22 |
| 3,352,556 | 11/1967 | Chaskin | 273/310 |
| 3,675,925 | 7/1972 | Ryan et al. | 273/312 |
| 3,792,535 | 2/1974 | Marshall et al. | 434/22 |
| 3,964,178 | 6/1976 | Marshall et al. | 434/22 X |
| 4,063,368 | 12/1977 | McFarland et al. | 434/22 |
| 4,185,825 | 1/1980 | Bromley | 273/313 |

*Primary Examiner*—William H. Grieb

*Attorney, Agent, or Firm*—Richard R. Mybeck

[57] ABSTRACT

The invention is directed to a device utilizing electromagnetic energy, within or close to the visible frequency range, and components sensitive to such energy to determine, indicate and record, without use of photographic technique or TV video recording, the aim of an object relative to a defined point at a defined instant or variations in aim during a defined time interval.

One characteristic feature of the device is that an available aiming aid, for instance a telescopic sight, is used to pick up energy radiated from the point towards which the object should be aimed.

20 Claims, 6 Drawing Figures

DEVICE TO DETERMINE, INDICATE AND RECORD AIM OF OBJECT

INTRODUCTION

The present invention relates generally to a targeting device and more particularly to a device which can determine, indicate and record the aim of an object relative to a defined point at a defined instant or during a defined time interval.

BACKGROUND OF THE INVENTION

Known in the prior art are many devices which can direct an object and maintain the aim thereof towards a source radiating electromagnetic energy and/or are capable of indicating and recording how an object is aligned towards a radiating source.

Exemplary of the prior art are the devices and systems described in U.S. Pat. Nos. 3,352,556, Chaskin; 3,675,925, Ryan et al; 3,792,535, Marshall et al; 3,964,178, Marshall et al; 4,063,368, McFarland et al; and 4,185,825, Bromley. However a careful review of each of said patents reveals that a need still and clearly exists for a device of the type described which is comparatively simple to construct and operate, which is small in size and of low weight, and which, utilizing an available aiming aid, for instance a telescopic sight, can determine, indicate and record (without use of photographic technique or TV video recording) the aim of an object toward a target at a defined instant or during a defined time interval.

The present invention, as will be discerned from a careful consideration of the following description and illustration of an exemplary embodiment thereof, meets that need and fulfills that object and such other objects as may hereafter appear in a remarkably unexpected fashion.

More particularly, the present invention utilizes the interrelationship between a target provided with a source radiating electromagnetic energy, within or close to visible frequency range, an aimable object, a conventional aiming aid, for instance a telescopic sight, disposed upon the aimable object, means for detecting the electromagnetic energy from said energy source, a plurality of energy sensing components strategically disposed to discriminate between a variety of energy waves reflected thereupon; means to reflect said detected energy to said energy sensing components; and means translating the response of said energy sensing components into a visible pattern which indicates whether the aim at the moment of firing is exactly at the center of the target and, if not, the deviation therefrom.

BRIEF SUMMARY OF THE INVENTION

The present invention presents a comparatively simple portable device for measuring, reporting and recording the aim of an aimable object relative to a defined point, either instantly or over time.

More particularly, the present invention utilizes the interrelationship between that device, a target provided with a source radiating electromagnetic energy within or close to the visible frequency range, an object to be aimed, and a conventional aiming aid, for instance a telescopic sight, disposed upon the object to be aimed, and coacting with the device which senses energy picked up by the aiming aid and measures, not only if the object is aimed exactly at the energy source but also if it is not so aimed, the actual deviations from exact aim that is present. In addition the device can indicate and record the aim at an accurately defined instant or indicate the aim variations during a defined time interval.

A clearer understanding of the present invention can be obtained from a careful consideration of the description in connection with the accompanying drawing in which like members bear like indicia throughout the several views.

DETAILED DESCRIPTION OF INVENTION

This description is based on an embodiment of the present invention when used on hunting rifles during training to permit the rifle to be aimed and fired and the result evaluated without using ammunition and without physically examining the target.

As will appear, the telescopic sight 10 of the rifle 42 is used to pick up energy from the energy source 32 disposed in the target 44. This use does not significantly disturb the aiming function of the sight.

The device for sensing energy via the telescopic sight and for indicating and recording the aim of the rifle at the moment of firing employs solid state components for sensing energy and for signal processing/referencing, and light emitting diodes for indication and recording.

Figure 1:
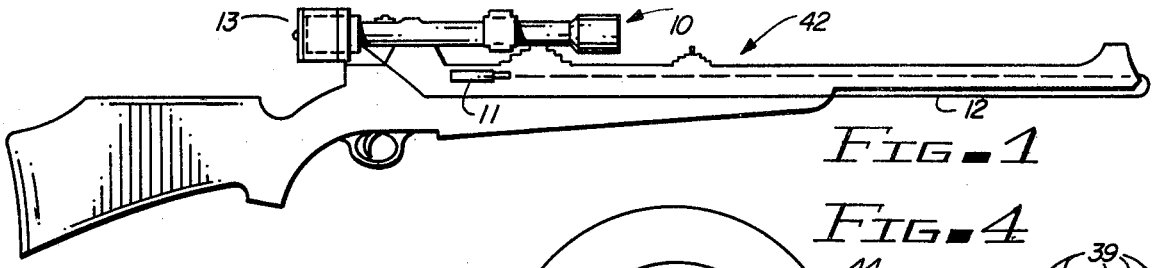
FIG. 1 is a side elevation of a device embodying the present invention in operative association with a rifle and a telescopic sight.

Referring to the drawing, a sensor 11, which can detect the movement resulting from firing the cartridge, is attached to rifle 42. As shown in FIG. 1, sensor 11 is placed in the cartridge chamber, senses the action of the firing pin and establishes contact between current conductors 12 connecting the sensor 11 with the device 13. Sensor 11 is designed to safeguard the firing pin and its mechanism from abnormal strain and to establish distinct contact at firing between the current conductors 12.

Device 13 receives energy from the ocular 14 of the telescopic sight 10 (in the following referred to as "the sight") and indicates the aim of the rifle at the moment of firing.

Figure 2:
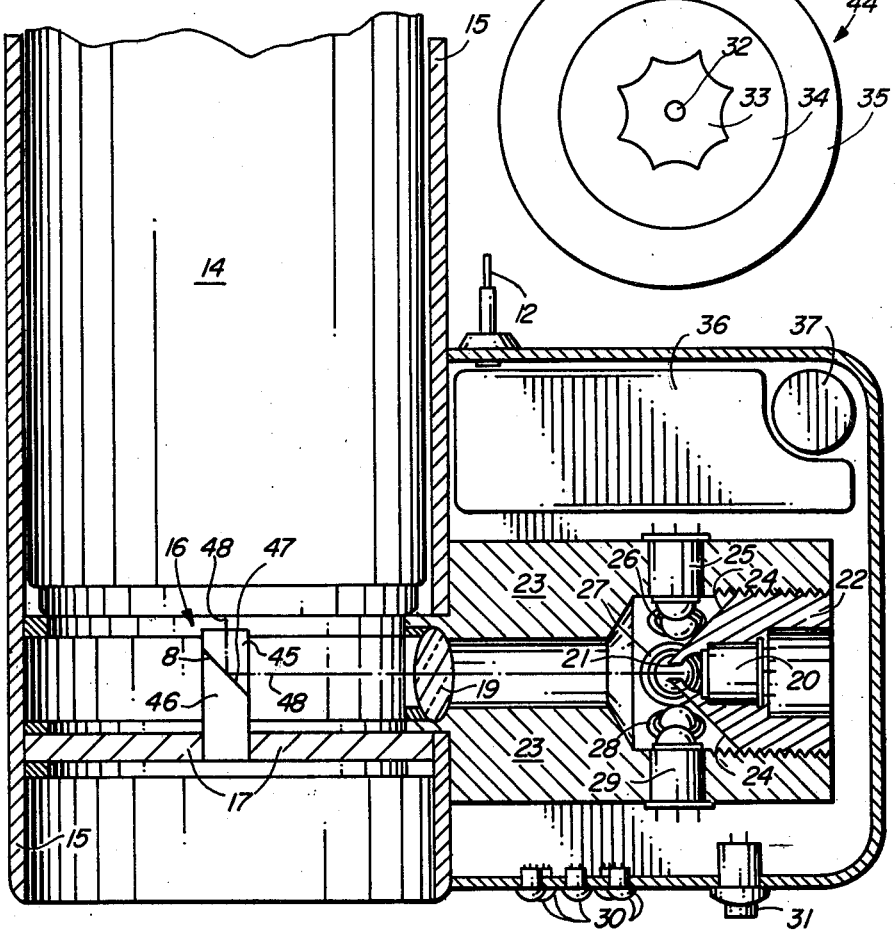
FIG. 2 is a cross section of the device and sight of FIG. 1, taken along line 2—2 in FIG. 3.
Figure 3:
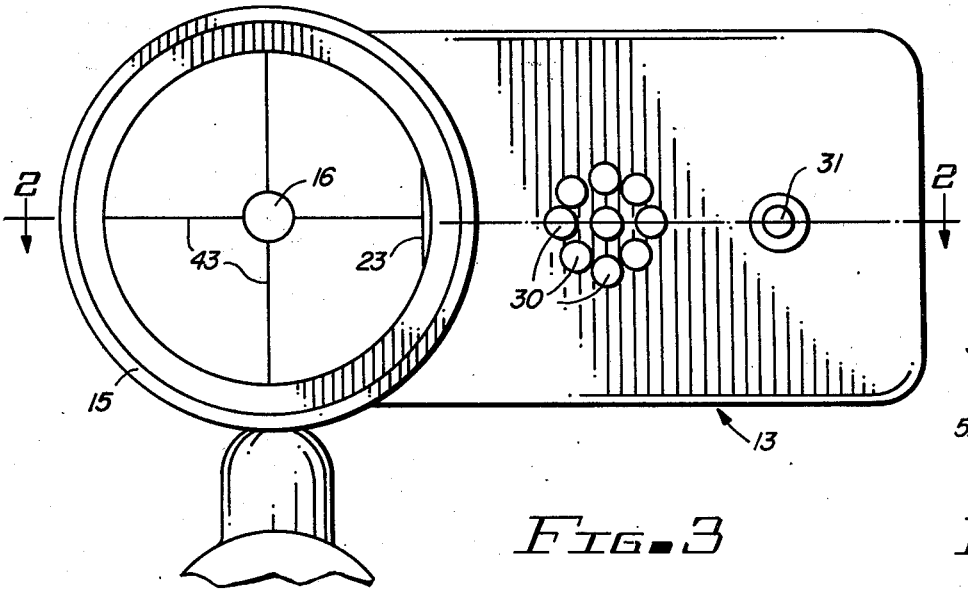
FIG. 3 is an enlarged end view of the device of FIG. 2.

One embodiment of device 13 is shown in FIGS. 2 and 3 in the drawing. In FIG. 2, a cross-section of device 13, the ocular 14 of the sight 10 has a casing 15 disposed around sight 10. Casing 15 may, for instance, have an inside cover of a flexible material which fixes the casing 15 to sight 10, and, alternatively, a mechanical arrangement can be used.

Within casing 15, which surrounds sight 10, is disposed a round glass plate 17 on which a crosshair 43 is etched to aid aligning the device 13 when applied on sight 10. A small glass rod 16 is fixed in the center of glass plate 17, and is made from two pieces 45, 46 joined at an angle of 45 degrees relative to the longitudinal axis of sight 10. One surface 47 in the joint is prepared to reflect part of the energy picked up by the sight towards lens 19. Device 13 with glass rod 16, lens 19 and a screw 22 is aligned relative to sight 10 so that a beam 48 passing through the center of the crosshair 43 of the sight glass 17 is directed to and through lens 19 to hole 21 disposed on the center axis to reach phototransistor 20. Beam 48 is illustrated by the dotted line.

Beams which do not pass through the center of lens 19 are diverted and hit the screw 22 close to the tip of its conical end surface 24. This surface is polished to act as a mirror and defines an angle of 45 degrees to a line passing through the center of lens 19 and hole 21. Thus a beam hitting surface 24 is reflected towards surrounding cylinder 23. A suitable number of phototransistors are mounted within cylinder 23 in spaced radial relationship to each other in this embodiment as illustrated by transistors 25, 26, 27, 28 and 29. In our preferred embodiment as shown in FIG. 2, eight such transistors will be disposed at 45 degree increments around the inner circumference of cylinder 23. Cylinder 23 is secured to casing 15 in any suitable fashion. However, when six transistors are used, the transistors will be disposed at 60 degree increments.

The energy source in the target, defined as to size and intensity, lens 19 and screw 22 are matched for a performance, in cooperation with the sight 10, so that a beam 48 through or very close to the center of lens 19 reaches phototransistor 20 only indicating a very good shot. When the beam from lens 19 reaches both phototransistor 20 and the end surface 24 near the hole 21, light is reflected by surface 24 towards one or two of the other phototransistors mounted in cylinder 23, depending on whether beam 48 hits surface 24 at a spot close to a line between one of the phototransistors in cylinder 23 and the center of the screw 22 or between two such spots whereupon a different signal is activated indicating the degree of the miss. Finally, when a beam hits lens 19 at such a distance from the lens center that very little or no part of the beam enters the hole 21, a like amount is reflected towards one or two of the phototransistors in cylinder 23 indicating a still wider miss in the shot. Of course, if the deviation from the lens center and the corresponding beam declination is too large, the reflected beam will fall outside of the sensitivity cones of the phototransistors in cylinder 23 and a complete miss will be indicated by the absence of a signal.

When the firing pin causes the sensor 11 to establish contact between the conductors 12, a pulse current with a duration of a few microseconds is produced by electronic circuitry in 13. This pulse acts with the output current from one or more of the phototransistors 20, 25, 26, 27, 28 and/or 29 to light the corresponding light emitting diode in the diode pattern 30.

Each phototransistor has its light emitting diode in a corresponding position in the diode pattern 30 and is connected to its diode via an amplifier and, for instance, a flipflop circuit. The amplification is so adjusted that battery voltage is applied on a diode at the moment a threshold level of energy is received by the corresponding phototransistor. Battery voltage remains on the diode and the diode remains lighted until the corresponding flipflop circuit is reset by use of push button 31.

Figure 4:
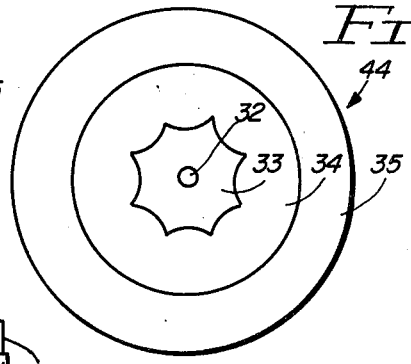
FIG. 4 is a showing of the zones about the target corresponding to indication by the pattern of the light emitting diode.

The characteristic data of lens 19 is selected so that device 13 will indicate the aim of the rifle 42 with the desired accuracy. The positioning of hole 21 and surface 24 assure that only phototransistor 20 receives sufficient energy to light its corresponding diode when the sight has its aiming point within the area 33 of the target 44 as shown in FIG. 4. Area 33 is an area of defined size centered around the energy source 32 in the target 44.

Lens 19 and surface 24 coact to bring the received energy beam to phototransistor 20 and one or two other of the phototransistors 25–29 in cylinder 23 when the rifle is aimeld at area 34 which circumscribes area 33. Finally, when the rifle is fired aiming at the defined area 35, which circumscribes area 34, the received energy beam is brought to one or two of the phototransistors 25–29 in cylinder 23 but not to phototransistor 20.

A suitable shielding arrangement and screw 22 prevent received energy from reaching any of the phototransistors 20, 25–29 when the rifle is fired while aimed outside of areas 33, 34 and 35.

As made evident by this description, it can be judged from the pattern of the lighted diodes 30 whether a target hit would have been high or low, to the left or right relative to the area 33, or high/low along a slant zone between the horizontal and vertical lines.

Figure 5:
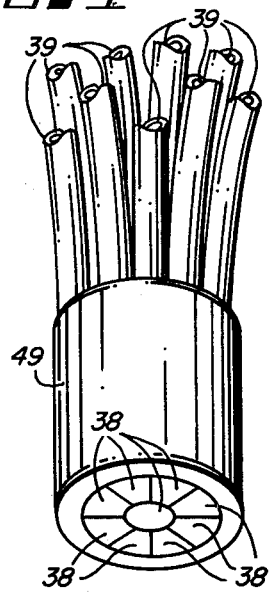
FIG. 5 is an isometric view of an alternative embodiment of the present invention utilizing optic fiber conductors to transmit energy from the ocular of the telescopic sight to the energy sensitive component.

Various other arrangements employing components which are sensitive to energy radiation can be used in the device 13 in place of the energy sensors disclosed above without straying from the basic teaching thereof. For instance, an optic fibre component 49 as shown in FIG. 5, can be used to determine, with certain accuracy, where a narrow beam hits a minute area. In FIG. 5 the area, within which the position of a beam shall be determined, is covered by nine end surfaces of optical fibre bundles, each one preferred for efficient energy reception. By the nine fibre conductors 39, corresponding respectively to the nine area elements 38, the received energy is conveyed to energy sensitive components. The area, within which radiated energy shall be sensed, can, of course, be covered by a greater number of fibre elements to obtain even a better resolution than achievable by nine elements.

Figure 6:
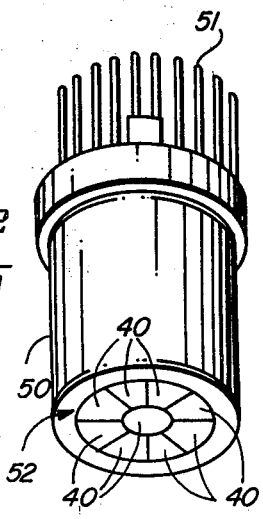
FIG. 6 is an isometric showing of still another embodiment of energy sensitive elements.

Another alternative embodiment of this invention utilizes a special component 50 illustrated in FIG. 6. Component 50 has nine energy sensitive elements 51 disposed within a minute area behind a suitable lens 52 divided into nine sub-areas 40. As before, a greater number of energy sensitive elements can, of course, be used when it is desired to obtain better resolution than that achievable by the nine illustrated elements 51.

Device 13 may also be designed to allow the currents, resulting from energy radiated from the target source reaching the energy sensitive components to be amplified and coordinated so as to represent the variations in aim prior to firing and the aim at the moment of firing, and to make possible recording of the aim variations by, for instance, pen recorders. A polar diagram can be plotted to indicate the deviations from the target center and the angles of the deviations. Alternatively two pen functions can be used to indicate vertical and horizontal deviation respectively, both as a function of time.

The telemetric electronic circuitry utilized hereby is well known and need not be described in detail. Space for housing the needed circuitry is provided as shown in FIG. 2 at 36. Similarly, FIG. 2 indicates a suitable space 37 for housing a battery.

From the foregoing it becomes apparent that the invention which has been herein described and illustrated fulfills all of the aforestated objectives in a remarkably unexpected fashion. It is of course understood that such modifications, alterations, and adaptations as may readily occur to an artisan confronted by this disclosure are intended within the spirit of the present invention whose scope is limited only by the scope of the claims appended hereto.

What is claimed is:

1. For use in a system for training personnel in aiming and firing weapons, said system comprising a weapon; a telescopic sight affixed to said weapon in aiming alignment therewith; and a target, free of wire and radio connections and disposed in spaced independent relationship to said weapon and visible through said sight, said target having means associated therewith at a defined point thereupon for emitting electromagnetic energy at or close to a visible frequency therefrom for reception by said sight; a device mounted to said weapon in cooperative coaction with said sight and comprising: a semi-transparent reflective surface disposed within said sight at an angle relative to the longitudinal axis of said sight for receiving target-emitted energy thereupon and reflecting said energy therefrom; energy sensing components strategically disposed to ultimately receive said reflected energy from said surface and discriminate the relative positioning thereof; and means translating said discriminant diversion of energy into a visible pattern demonstrating whether the aim at the moment of firing is at the defined point and, if not, the deviation therefrom.

2. A device according to claim 1 having a conical reflecting member having an opening defined at the apex thereof and operatively interposed between said reflecting surface and said energy sensing components to receive reflected energy from said reflecting surface and discriminately divert said energy to one or more of said components in relation to whether said reflected energy impinges upon said conical surface or passes through said opening.

3. A device according to claim 2 in which one sensing component corresponding to a direct hit is disposed beneath said conical member and other sensing components corresponding to various misses are disposed in spaced circumferential relationship about said conical reflecting member.

4. A device according to claim 3 in which said reflective surface is flat.

5. A device according to claim 4 in which said flat reflective surface is disposed at an angle of 45° relative to the longitudinal axis of said sight.

6. A device according to claim 3 having a lens member operatively interposed between said reflecting surface and said conical reflecting member to pass reflected energy from said surface to said conical member.

7. A device according to claim 1 including means producing an output providing said visible pattern during a defined time interval.

8. A device according to claim 1 including means producing an output to convert said visible pattern into a permanent record.

9. For use in a system for training personnel in aiming and firing weapons, said system comprising a weapon; a telescopic sight affixed to said weapon in aiming alignment therewith; and a target, free of wire and radio connections and disposed in spaced independent relationship to said weapon and visible through said sight, said target having means associated therewith at a defined point thereupon for emitting electromagnetic energy at or close to a visible frequency therefrom for reception by said sight; a device mounted to said weapon in cooperative coaction with said sight and comprising: a semi-transparent reflective surface disposed within said sight at an angle relative to the longitudinal axis of said sight for receiving target emitted energy thereupon and reflecting said energy therefrom; electromagnetic energy sensing elements strategically disposed in a minute area in the path of said reflected energy to receive said reflected energy from said surface, detect the diversion thereof and translate said discriminant diversion of energy into a visible pattern demonstrating whether the aim at the moment of firing is at the defined point and, if not, the deviation therefrom.

10. A device according to claim 9 in which said reflective surface is flat.

11. A device according to claim 10 in which said flat reflective surface is disposed at an angle of 45° relative to the longitudinal axis of said sight.

12. A device according to claim 9 having a lens member operatively interposed between said reflecting surface and said electromagnetic sensing elements to pass reflected energy from said surface to said elements.

13. A device according to claim 9 including means producing an output providing said visible pattern during a defined time interval.

14. A device according to claim 9 including means producing an output to convert said visible pattern into a permanent record.

15. For use in a system for training personnel in aiming and firing weapons, said system comprising a weapon; a telescopic sight affixed to said weapon in aiming alignment therewith; and a target, free of wire and radio connections and disposed in spaced independent relationship to said weapon and visible through said sight, said target having means associated therewith at a defined point thereupon for emitting electromagnetic energy at or close to a visible frequency therefrom for reception by said sight; a device mounted to said weapon in cooperative coaction with said sight and comprising: a semi-transparent reflective surface disposed within said sight at an angle relative to the longitudinal axis of said sight for receiving target emitted energy thereupon and reflecting said energy therefrom; a plurality of optic fiber conductors having their ends compacted into a minute area strategically disposed in the path of said reflected energy to receive said reflected energy from said surface and discriminate between those beams which are on center and off-center to produce a visible pattern demonstrating whether the aim at the moment of firing is at the defined point and, if not, the deviation therefrom.

16. A device according to claim 15 in which said reflective surface is flat.

17. A device according to claim 16 in which said flat reflective surface is disposed at an angle of 45° relative to the longitudinal axis of said sight.

18. A device according to claim 15 including means producing an output providing said visible pattern during a defined time interval.

19. A device according to claim 15 including means producing an output to convert said visible pattern into a permanent record.

20. A device according to claim 15 having a lens member operatively interposed between said reflective surface and said optic fiber conductors to pass reflected energy from said surface to said conductors.

* * * * *